US009476000B2

(12) United States Patent
Bisht et al.

(10) Patent No.: US 9,476,000 B2
(45) Date of Patent: Oct. 25, 2016

(54) HYDROTREATING PROCESS AND APPARATUS

(71) Applicant: UOP LLC, Des Plaines, IL (US)

(72) Inventors: Deepak Bisht, Dwarka (IN); Soumendra Banerjee, Dwarka (IN)

(73) Assignee: UOP LLC, Des Plaines, IL (US)

( * ) Notice: Subject to any disclaimer, the term of this patent is extended or adjusted under 35 U.S.C. 154(b) by 315 days.

(21) Appl. No.: 13/938,918

(22) Filed: Jul. 10, 2013

(65) Prior Publication Data

US 2015/0014218 A1 Jan. 15, 2015

(51) Int. Cl.

| | |
|---|---|
| ***C10G 65/06*** | (2006.01) |
| ***C10G 49/22*** | (2006.01) |
| ***C10G 65/04*** | (2006.01) |
| ***C10G 49/00*** | (2006.01) |

(52) U.S. Cl.

CPC ..... *C10G 65/06* (2013.01); *C10G 49/002* (2013.01); *C10G 49/22* (2013.01); *C10G 65/04* (2013.01); *C10G 2300/104* (2013.01); *C10G 2300/1037* (2013.01); *C10G 2300/1044* (2013.01); *C10G 2400/02* (2013.01)

(58) Field of Classification Search

CPC ..... C10G 65/06; C10G 45/02; C10G 45/32; C10G 45/72; C10G 49/22

See application file for complete search history.

(56) References Cited

U.S. PATENT DOCUMENTS

| | | | | |
|---|---|---|---|---|
| 6,444,118 | B1 * | 9/2002 | Podrebarac et al. | 208/210 |
| 6,787,025 | B2 | 9/2004 | Mukherjee et al. | |
| 6,843,906 | B1 | 1/2005 | Eng | |
| 7,005,058 | B1 * | 2/2006 | Towler | 208/211 |
| 8,404,103 | B2 | 3/2013 | Dziabala et al. | |
| 2009/0159493 | A1 | 6/2009 | Bhattacharya | |
| 2014/0054198 | A1 * | 2/2014 | Podrebarac | 208/57 |

* cited by examiner

*Primary Examiner* — Renee E Robinson

(57) ABSTRACT

A process for hydrotreating full range naphtha is disclosed including the steps of passing a vapor stream composed of naphtha hydrocarbons to a first catalyst bed of a hydrotreating reactor, passing a liquid stream composed of naphtha hydrocarbons to a second catalyst bed of the hydrotreating reactor, and recovering a hydrotreated product stream from the hydrotreating reactor. The first and second catalyst beds are arranged in series within the hydrotreating reactor, and the second catalyst bed is downstream of the first catalyst bed.

19 Claims, 1 Drawing Sheet

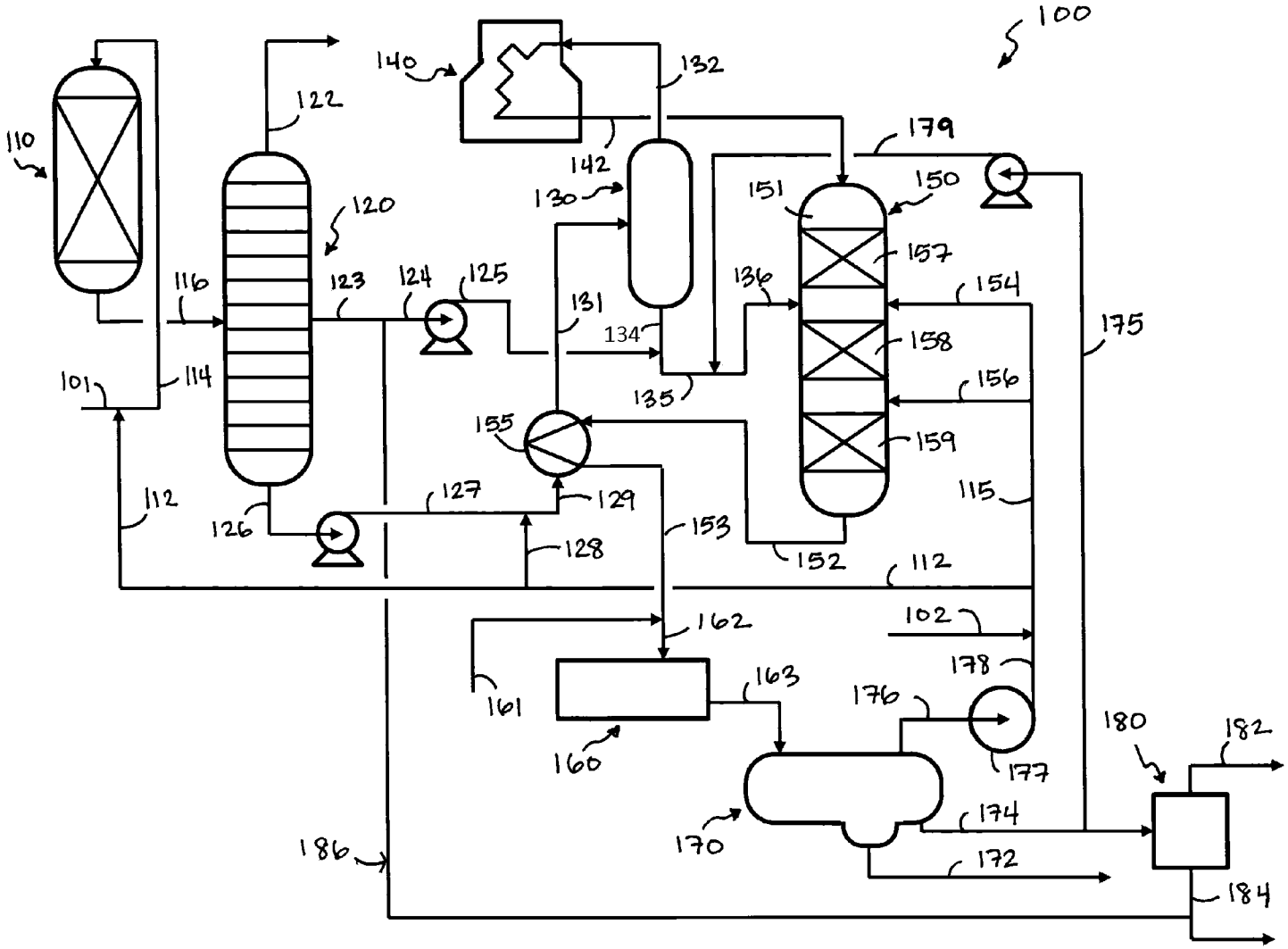
100
110
101
112
114
116
120
122
123
124
125
126
127
128
129
130
131
132
134
135
136
140
142
150
151
152
153
154
155
156
157
158
159
160
161
162
163
170
172
174
175
176
178
179
180
181
182
184
186
102
115

HYDROTREATING PROCESS AND APPARATUS

BACKGROUND OF THE INVENTION

1. Field of the Invention

The present invention relates to methods for treating full range naphtha feedstock using a combination of distillation and hydrotreating to provide naphtha products with reduced sulfur content while minimizing reduction in octane number.

2. Description of the Related Art

Naphtha is a complex mixture of liquid hydrocarbons, which includes hydrocarbon molecules having between five and twelve carbon atoms and a boiling point range of about 30° C. to about 200° C. A number of process units produce naphtha product streams including, crude distillation, catalytic cracking, delayed coking and visbreaking units. These naphtha streams often are characterized by low octane numbers and the presence of different types of contaminants such as nitrogen, sulfur and oxygen containing molecules.

Refiners often subject naphtha streams to hydrotreating operations such as hydrodesulfurization in order to remove the nitrogen, sulfur and other contaminants that can reduce catalyst activity. A number of challenges associated with naphtha hydrotreating include maintaining an exclusively vapor phase across charge heaters leading to the hydrotreating reactor, avoiding excessive heating across the catalyst beds of the hydrotreating reactor, and mitigating reductions in octane number.

There is consequently a demand for new hydrotreating processes which can effectively address the aforementioned challenges. Ideally, the products of these processes, should have a sufficiently low sulfur content to meet applicable standards and have a sufficiently high octane number for use in gasoline blending.

SUMMARY OF THE INVENTION

The inventors have made the surprising discovery that processes for hydrotreating of feedstocks such as full range naphtha can be greatly improved by separating the feedstock into vapor and liquid fractions that are made to enter the hydrotreating reactor at different locations. For example, a full range naphtha feedstock is first routed to a diolefin reactor, where the diolefins (if present) in the feed are saturated. The diolefin reactor effluent is then routed to a naphtha splitter, where the full range naphtha is split into three cuts. The top cut is called the light naphtha fraction and contains the maximum amount of light olefins. Recovery of the light naphtha fraction can be optimized to maximize olefin recovery from the naphtha splitter overhead subject to minimizing sulfur to meet the overall sulfur specification for the pool. Depending on the final sulfur specifications of the gasoline pool, the light naphtha fraction can either be directly routed to storage or treated in a mercaptan oxidation unit to treat the light mercaptans present.

The other two cuts from the splitter are a medium naphtha fraction taken as a side draw from the column and a heavy naphtha fraction recovered as a bottoms product. The heavy naphtha fraction contains the maximum amount of sulfur compounds and is routed to the hydrotreating unit. The heavy naphtha fraction is mixed with a recycled hydrogen rich gas stream and routed through a combined feed exchanger. The effluent from the combined feed exchanger is routed to a hot separator where the vapor and liquid are separated. The vapor is routed to a charge heater, the fuel firing of which is controlled by the hydrotreating reactor inlet temperature controller. The presence of the hot separator ensures that, under no circumstances does any liquid enter the charge heater. The heater always receives a vapor phase and this mitigates the concern of coil dry spots resulting in coking.

The vapor from the charge heater is then routed to the first catalyst bed of the hydrotreating reactor. The liquid from the hot separator is combined with the medium naphtha fraction and routed to the second bed of the hydrotreating reactor. Feeding a naphtha vapor stream to the first catalyst bed and a naphtha liquid stream to the second catalyst bed effectively splits the olefin saturation between the top two beds of the hydrotreating reactor. The split feed scheme also ensures that the temperature rise due to olefin saturation is distributed between the top two beds of the hydrotreating reactor and mitigates high temperature rise across any one bed resulting thereby increasing the life of the catalyst.

The split between medium naphtha and heavy naphtha fractions, or alternatively the depth of each bed can be optimized to minimize reduction of research octane number to meet the sulfur specifications. A control valve on the hot separator liquid balances the pressure drop across the charge heater and the top bed of the reactor. Routing of the liquid directly to the second bed of the reactor also provides a liquid quench and cuts back on the amount of quench gas (hydrogen rich gas) required to maintain the second bed inlet temperature. This gives a reduction in the recycle gas compressor capacity and enables the use of the existing compressor for revamping and upgrades to the process. To the inventors knowledge, the prior art does not consider such a split flow scheme with a separator upstream of the charge heater.

Accordingly, one embodiment of the invention is directed to a process for hydrotreating full range naphtha, including the steps of passing a vapor stream containing naphtha hydrocarbons to a first catalyst bed of a hydrotreating reactor, passing a liquid stream containing naphtha hydrocarbons to a second catalyst bed of the hydrotreating reactor, and recovering a hydrotreated product stream from the hydrotreating reactor. The first and second catalyst beds are arranged in series within the hydrotreating reactor, and the second catalyst bed is downstream of the first catalyst bed.

In one aspect, the liquid stream further contains a heavy naphtha fraction and a medium naphtha fraction and the vapor stream further contains a heavy naphtha fraction. In another aspect the process additionally involves the steps of separating a full range naphtha feedstock into a number of fractions containing the medium naphtha fraction and the heavy naphtha fraction, passing the heavy naphtha fraction to a vapor-liquid separation unit to produce the vapor stream and a heavy naphtha liquid stream, and admixing the medium naphtha fraction with the heavy naphtha liquid stream to produce the liquid stream. In yet another aspect, the fractions further comprises a light naphtha fraction.

In one aspect, the process includes separating the full range naphtha feedstock using distillation. In another aspect, the light naphtha fraction contains naphtha hydrocarbons having a boiling point range of 30° C. to about 70° C., the medium naphtha fraction contains naphtha hydrocarbons having a boiling point range of 70° C. to about 110° C., and the heavy naphtha fraction contains naphtha hydrocarbons having a boiling point range of 110° C. to about 220° C.

In another aspect of the process, the hydrotreating reactor catalyzes hydrogenation and hydrodesulfurization of the naphtha hydrocarbons. In another aspect, process further includes passing the vapor stream to a charge heater prior to step (a). In yet another aspect, the vapor stream further contains a hydrogen rich gas stream. In yet another aspect, the process includes the step of passing the full range naphtha feedstock to a diolefin reactor to at least partially hydrogenate diolefins in the full range naphtha feedstock prior to separating the full range naphtha feedstock into a plurality of fractions.

In a second embodiment, a process for hydrotreating full range naphtha, includes the steps of passing a full range naphtha feedstock to a diolefin reactor to at least partially hydrogenate diolefins in the full range naphtha feedstock, separating the at least partially hydrogenated full range naphtha feedstock into a number of fractions including a light naphtha fraction, a medium naphtha fraction and a heavy naphtha fraction, passing the heavy naphtha fraction to a vapor-liquid separation unit to produce a vapor stream and a heavy naphtha liquid stream, admixing the medium naphtha fraction with the heavy naphtha liquid stream to produce a mixed naphtha liquid stream, passing the heavy naphtha vapor stream to a first catalyst bed of a hydrotreating reactor, passing the mixed naphtha liquid stream to a second catalyst bed of the hydrotreating reactor, and recovering a hydrotreated product stream from the hydrotreating reactor. The first and second catalyst beds are arranged in series within the hydrotreating reactor, and the second catalyst bed is downstream of the first catalyst bed.

In one aspect, separating the at least partially hydrogenated full range naphtha feedstock into a number of fractions of involves distillation. In another aspect, the light naphtha fraction contains naphtha hydrocarbons having a boiling point range of 30° C. to about 70° C., the medium naphtha fraction contains naphtha hydrocarbons having a boiling point range of 70° C. to about 110° C., and the heavy naphtha fraction contains naphtha hydrocarbons having a boiling point range of 110° C. to about 220° C.

In another aspect of the process, the hydrotreating reactor catalyzes hydrogenation and hydrodesulfurization of the naphtha hydrocarbons. In yet another aspect, the process includes the step of passing the vapor stream to a charge heater prior to passing the heavy naphtha vapor stream to the first catalyst bed of the hydrotreating reactor. In yet another aspect, the vapor stream is admixed with a hydrogen rich gas stream prior to passing the heavy naphtha vapor stream to the first catalyst bed of the hydrotreating reactor.

In a third embodiment, an apparatus for hydrotreating full range naphtha includes a diolefin reactor in downstream communication with a full range naphtha feedstock conduit, a separation unit in downstream communication with the diolefin reactor and in upstream communication with a number of naphtha fraction conduits including a medium naphtha fraction conduit and a heavy naphtha fraction conduit, a vapor-liquid separation unit in downstream communication with the heavy naphtha fraction conduit and in upstream communication with a vapor conduit and a heavy naphtha liquid conduit, a mixed naphtha liquid conduit in downstream communication with the medium naphtha fraction conduit and the heavy naphtha liquid conduit, and a hydrotreating reactor including a first catalyst bed and a second catalyst bed. In one aspect, the first catalyst bed is in downstream communication with the vapor conduit and the second catalyst bed is in downstream communication with the mixed naphtha liquid conduit. In another aspect, the first and second catalyst beds are arranged in series within the hydrotreating reactor, and the second catalyst bed is in downstream communication with the first catalyst bed.

In one aspect, the separation unit includes a distillation column. In another aspect, the apparatus further includes a charge heater in downstream communication with the vapor conduit and in upstream communication with the first catalyst bed. In yet another aspect, the apparatus includes a hydrogen rich gas conduit in upstream communication with vapor conduit.

BRIEF DESCRIPTION OF THE DRAWINGS

FIG. 1 illustrates a hydrotreating process for treating a full range naphtha feedstock according to the invention.

DETAILED DESCRIPTION OF THE INVENTION

1. Definitions

As used herein, the following terms have the corresponding definitions.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of the reflux or reboil to the column.

As used herein, the term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

2. Detailed Description

An embodiment of a hydrotreating process of the present invention is illustrated by the FIGURE. Hydrotreating processes are used to remove undesirable materials from a feedstock by selective reactions with hydrogen in a heated catalyst bed. Such processes remove sulfur, nitrogen and certain metal contaminants that are often poisonous to downstream catalyst-based processes.

Suitable feedstocks include full range naphtha from fluid catalytic cracking operations, although the use of other petroleum feedstocks is possible. Alternative feedstocks include various other types of hydrocarbon mixtures, such as cracked naphtha obtained as a product of steam cracking, thermal cracking, visbreaking or delayed coking.

Full range naphtha feedstocks normally contain organic nitrogen compounds and organic sulfur compounds. For example, naphtha feedstocks typically contain from about 0.1% to about 4%, normally from about 0.2% to about 2.5%, and often from about 0.5% to about 2%, by weight of total sulfur, substantially present in the form of organic sulfur compounds such as alkylbenzothiophenes. Such distillate feedstocks also generally contain from about 50 ppm to about 700 ppm, and normally from about 50 ppm to about 100 ppm, by weight of total nitrogen, substantially present in the form of organic nitrogen compounds such as non-basic aromatic compounds including cabazoles. A representative full range naphtha feedstock will therefore contain about 1% by weight of sulfur, about 500 parts per million (ppm) by weight of nitrogen, and greater than about 70% by weight of 2-ring and multi-ring aromatic compounds.

Referring now to FIG. 1, a feedstock, such as full range naphtha, enters the illustrated process 100 through a line 101 in communication with a reactor 110. In the present example, the reactor 110 is a diolefin reactor for the hydrogenation of diolefins present in the feedstock in line 101. The di-olefin reactor 110 selectively hydrogenates the diolefins present in the FCC Naphtha feed. One non-limiting example catalyst used for this comprises metal oxides on alumina. The metals are preferably nickel and molybdenum (Group VIII and Group VI in the periodic table). The di-olefins reactor 110 has a operating temperature in the range of 140-210° C. and pressure is in the range of 25-30 kg/cm$^2$g.

An effluent is recovered from the reactor 110 in a line 116, which is in communication with a separation unit 120. The separation unit 120 comprises one or more separation vessels designed for splitting the full range naphtha feedstock into a number of fractions. Preferably, the naphtha feedstock is recovered as light, medium and heavy fractions based on true boiling point cuts, wherein the separation unit includes a distillation column. In one embodiment, the light naphtha fraction would have a boiling point range of about a minimum boiling point of the naphtha feedstock to about 70° C., the medium naphtha fraction would have a boiling point range of about 70° C. to about 110° C. and the heavy naphtha fraction would have a boiling point range of about 110° C. to about 220° C. However, one skilled in the art will recognize that it is desirable to tailor the separation of the naphtha fractions to meet process requirements.

In the embodiment illustrated in FIG. 1, the light naphtha faction is recovered from the separation zone 120 in a line 122. Depending on the presence and concentration of contaminants in the light naphtha fraction, an extraction step is performed. In the case where an extraction is required, the line 122 is in communication with downstream units (not shown) for purification of the light naphtha fraction. For example, the light naphtha fraction may be subjected to a mercaptan oxidation process (i.e., Merox) to remove sulfur containing mercaptans.

In addition to the light naphtha fraction, the medium naphtha fraction is recovered from the separation zone 120 in the line 123, while the heavy naphtha fraction is recovered in the line 126. In certain embodiments, each of the medium and heavy naphtha fractions are passed to downstream locations through the use of a pump. In FIG. 1, The medium naphtha fraction in line 123 and a portion of hydrotreated naphtha in line 186 is admixed in line 124. Line 124 is in communication with a line 125 by way of a pump. Similarly, the heavy naphtha fraction in the line 126 is in communication with the line 127 by way of a pump.

Ultimately, the medium and heavy naphtha fractions are both passed to a hydrotreating unit 150. In conventional processes known in the art, the non-fractionated naphtha feedstock is initially vaporized and then passed to the first of one or more of a series of catalyst beds in a hydrotreating reactor. The present process 100 differs from convention in that initial fractionation of the naphtha feedstock allows for the various fractions to be processed individually and passed to the hydrotreating unit 150 at distinct points. In one embodiment, the heavy naphtha fraction from line 127 is admixed with a hydrogen containing gas stream from line 128 in a line 129. The heavy naphtha/hydrogen mixture in the line 129 is passed through a heat exchanger 155 to recover thermal energy from the effluent of the hydrotreating unit 150. The preheated heavy naphtha/hydrogen mixture exits the heat exchanger 155 in line 131. Line 131 is in communication with a hot separator 130. The hot separator 130 separates the preheated mixture from line 131 into vapor and liquid phases. This separation step ensures only vapor (and no liquid) enters the charge heater 140.

The vapor phase from the hot separator 130 is in communication with the charge heater 140 by way of line 132. The charge heater 140 further heats the vaporized heavy naphtha/hydrogen mixture. The mixture leaves the charge heater 140 in a line 142 in communication with the hydrotreating unit 150.

The heavy naphtha/hydrogen liquid phase leaves the hot separator 130 via the line 134. The heavy naphtha/hydrogen liquid phase in line 134 and the medium naphtha fraction in line 125 are admixed in line 135 in communication with the hydrotreating unit 150. In certain implementations, it is desirable to recycle a portion of a hydrotreated naphtha stream back to the hydrotreating unit 150. In this case, the liquid admixture in line 135 and a portion of a hydrotreated naphtha stream in line 179 are admixed in line 136. The liquid admixture in line 136 is passed to the hydrotreating unit 150. The hydrotreating unit 150 includes one or more hydrotreating reactors (hydrotreaters) for removing sulfur from the naphtha fractions. In the illustrated embodiment, the hydrotreating unit 150 consists of a hydrotreater 151 with three catalyst beds 157, 158, 159 in series. In the illustrated embodiment, the heated heavy naphtha/hydrogen vapor mixture in line 142 enters the hydrotreater 151 and contacts the first catalyst bed 157. Meanwhile, the liquid admixture enters the hydrotreater 151 between catalyst beds 157 and 158. A number of reactions take place in the hydrotreater including hydrogenation of olefins and hydrodesulfurization of mercaptans and other sulfur compounds—both of which (olefins and sulfur compounds) are present in the naphtha fractions. Examples of sulfur compounds that may be present include dimethyl sulfide, thiophenes, benzothiophenes, and the like. Preferably, the reactions in the hydrotreater are selective to desulfurization and whereas hydrogenation of olefins is minimized.

It is an advantage over the conventional process to split the naphtha fractions between the top two beds 157, 158 of the hydrotreater 151. First, hydrogenation of olefins in the hydrotreater 151 is an exothermic process that results in a temperature rise across the catalyst beds 157, 158, 159. The split feed scheme (i) ensures that the temperature rise due to olefin saturation is distributed between the top two beds and (ii) mitigates high temperature rise across any one bed. Reducing temperature rise also results in an extended catalyst life. In addition to reducing temperature rise and extending catalyst life, routing of the liquid admixture directly to the second bed 158 of the hydrotreater 151 also provides a liquid quench and cuts back on the amount of quench gas required to maintain the second bed 158 inlet temperature. This results in a reduction in the recycle gas compressor capacity and enables the use of an existing compressor in the case of future renovations or upgrades to the process.

Preferred hydrotreating reaction conditions include a temperature from 260° C. (500° F.) to 455° C. (850° F.), suitably 316° C. (600° F.) to 427° C. (800° F.) and preferably 300° C. (572° F.) to 399° C. (750° F.), a pressure from 0.68 MPa (100 psig), preferably 1.34 MPa (200 psig), to 6.2 MPa (900 psig), a liquid hourly space velocity of the fresh hydrocarbonaceous feedstock from 0.2 $hr^{-1}$ to 4 $hr^{-1}$, preferably from 1.5 to 3.5 $hr^{-1}$, and a hydrogen rate of 168 to 1,011 $Nm^3/m^3$ hydrocarbon (1,000-6,000 scf/bbl), preferably 168 to 674 Nm3/m3 oil (1,000-4,000 scf/bbl), with a hydrotreating catalyst or a combination of hydrotreating catalysts.

Suitable hydrotreating catalysts include those comprising of at least one Group VIII metal, such as iron, cobalt, and nickel (e.g., cobalt and/or nickel) and at least one Group VI metal, such as molybdenum and tungsten, on a high surface area support material such as a refractory inorganic oxide (e.g., silica or alumina). A representative hydrotreating catalyst therefore comprises a metal selected from the group consisting of nickel, cobalt, tungsten, molybdenum, and mixtures thereof (e.g., a mixture of cobalt and molybdenum), deposited on a refractory inorganic oxide support (e.g., alumina).

Other suitable hydrotreating catalysts include zeolitic catalysts, as well as noble metal catalysts where the noble metal is selected from palladium and platinum. It is within the scope of the invention to use more than one type of hydrotreating catalyst in the same or a different reaction vessel. Two or more hydrotreating catalyst beds of the same or different catalyst and one or more quench points may be utilized in a reaction vessel or vessels to provide the hydrotreated product.

An effluent stream leaves the hydrotreater 150 through line 152. As mentioned previously, the effluent stream is subjected to indirect heat exchange with the heavy naphtha/hydrogen mixture in line 129. The effluent stream enters the heat exchanger 155 through line 152 and exits the heat exchanger 155 through line 153. Wash water in line 161 and the effluent in line 153 are admixed in the line 163. Wash water is immiscible with the organic naphtha in the effluent stream. However, hydrogen sulfide and other contaminants in the effluent from the hydrotreating unit 150 will selectively partition into the aqueous phase.

Additional cooling of the effluent/water mixture takes place in condenser 160. The cooling step results in a first liquid (aqueous) phase composed of water and other contaminants (a.k.a., "sour water"), a second liquid (organic phase) composed of hydrotreated naphtha and a hydrogen rich gas phase. The effluent/water mixture enters the condenser 160 through line 162 and leaves the condenser through a line 163 in communication with cold separator 170. The cold separator 170 separates the three-phase mixture into a sour water stream in line 172, a hydrotreated naphtha stream in line 174 and a hydrogen containing gas stream in line 176. As described previously, a portion of the hydrotreated naphtha stream in line 174 may be recycled to the hydrotreating unit 150 via line 179. A portion of line 174 is recycled in line 175, which is in communication with line 179 via a pump. Line 175 is a normally no flow (NNF) line. This line is not used in normal operation. However if there is a temperature excursion in the first bed 157 of the hydrotreater 151, it is desirable to recycle hydrotreated naphtha liquid from the line 174 to control the exotherm as opposed to feeding additional material that contains olefins.

Line 172 is in communication with downstream units (not shown) for processing the sour water. Hydrotreated naphtha in line 174 is further treated as necessary. For example, the hydrotreated naphtha may be passed to a distillation column to recover additional contaminants such as hydrogen, methane, ethane, hydrogen sulfide, propane, and the like. In the illustrated embodiment, line 174 is in communication with a stripping unit 180. The stripping unit 180 produces a distillate product in line 182 and a bottoms product in line 184. A portion of the bottoms product in line 184 can be recycled in the line 186 to the hydrotreating unit 150. Line 186 and line 123 are admixed in line 124. Analogous to line 175, line 186 is an NNF line that is employed to manage temperature excursions that arise in the first bed 157 of the hydrotreater 151. Whereas the material flowing in recycle line 175 from the cold separator 170 needs to be pumped, the material in line 186 does not as the stripping unit 180 normally operates at a high enough pressure.

Finally, the hydrogen rich gas stream in line 176 is recycled back to the process 100. The hydrogen gas enters compressor 177 through line 176 and the compressed gas exits through line 178. The compressed hydrogen gas in line 178 and the make-up hydrogen rich gas in line 102 are admixed in the line 115. A fraction of the hydrogen rich gas mixture in line 115 is passed via the line 112 to additional points in the process 100. For example, hydrogen rich gas in the line 112 is admixed with the naphtha feedstock in the line 101. A fraction of the hydrogen rich gas in line 112 is also passed via line 128 for admixing with the heavy naphtha fraction from the separation unit 120 in line 127. The remainder of the hydrogen rich gas in the line 115 enters the hydrotreating unit 150. A fraction of the hydrogen rich gas from line 115 enters the hydrotreater 151 between the first and second beds 157, 158 through the line 154, while the remainder enters between the second and third beds 158, 159 through the line 156.

Although the invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

What is claimed is:

1. A process for hydrotreating full range naphtha, the process comprising:

(a) passing a heavy naphtha fraction to a vapor-liquid separation unit to produce a vapor stream comprising naphtha hydrocarbons and a heavy naphtha liquid stream;

(b) passing the vapor stream to a charge heater;

(c) passing the vapor stream from the charge heater to a first catalyst bed of a hydrotreating reactor vessel;

(d) passing a liquid stream comprising naphtha hydrocarbons and an effluent from the first catalyst bed to a second catalyst bed of the hydrotreating reactor vessel; and (e) recovering a hydrotreated product stream from the hydrotreating reactor vessel;

wherein the first and second catalyst beds are arranged in series within the hydrotreating reactor vessel, and the second catalyst bed is downstream of the first catalyst bed.

2. The process of claim 1, wherein:

the liquid stream comprises the heavy naphtha liquid stream and a medium naphtha fraction.

3. The process of claim 2, further comprising:

separating a full range naphtha feedstock into a plurality of fractions comprising the medium naphtha fraction and the heavy naphtha fraction; and admixing the medium naphtha fraction with the heavy naphtha liquid stream to produce the liquid stream.

4. The process of claim 3, wherein separating the full range naphtha feedstock involves distillation.

5. The process of claim 3, wherein the plurality of fractions further comprises a light naphtha fraction.

6. The process of claim 5, wherein the light naphtha fraction comprises naphtha hydrocarbons having a boiling point range of 30° C. to about 70° C.;

the medium naphtha fraction comprises naphtha hydrocarbons having a boiling point range of 70° C. to about 110° C.; and the heavy naphtha fraction comprises naphtha hydrocarbons having a boiling point range of 110° C. to about 220° C.

7. The process of claim 3, further comprising:

passing the full range naphtha feedstock to a diolefin reactor to at least partially hydrogenate diolefins in the full range naphtha feedstock prior to separating the full range naphtha feedstock into a plurality of fractions.

8. The process of claim 1, wherein the hydrotreating reactor catalyzes hydrogenation and hydrodesulfurization of the naphtha hydrocarbons.

9. The process of claim 1, wherein the vapor stream further comprises a hydrogen rich gas stream.

10. A process for hydrotreating full range naphtha, the process comprising:

(a) passing a full range naphtha feedstock to a diolefin reactor to at least partially hydrogenate diolefins in the full range naphtha feedstock;

(b) separating the at least partially hydrogenated full range naphtha feedstock into a plurality of fractions comprising a light naphtha fraction, a medium naphtha fraction and a heavy naphtha fraction;

(c) passing the heavy naphtha fraction to a vapor-liquid separation unit to produce a vapor stream and a heavy naphtha liquid stream;

(d) admixing the medium naphtha fraction with the heavy naphtha liquid stream to produce a mixed naphtha liquid stream;

(e) passing the heavy naphtha vapor stream to a first catalyst bed of a hydrotreating reactor vessel;

(f) passing the mixed naphtha liquid stream and the entire effluent from the first catalyst bed to a second catalyst bed of the hydrotreating reactor vessel; and (g) recovering a hydrotreated product stream from the hydrotreating reactor;

wherein the first and second catalyst beds are arranged in series within the hydrotreating reactor vessel, and the second catalyst bed is downstream of the first catalyst bed.

11. The process of claim 10, wherein step (b) comprises distillation of the at least partially hydrogenated naphtha feedstock.

12. The process of claim 10, wherein the light naphtha fraction comprises naphtha hydrocarbons having a boiling point range of 30° C. to about 70° C.;

the medium naphtha fraction comprises naphtha hydrocarbons having a boiling point range of 70° C. to about 110° C.; and the heavy naphtha fraction comprises naphtha hydrocarbons having a boiling point range of 110° C. to about 220° C.

13. The process of claim 10, wherein the hydrotreating reactor catalyzes hydrogenation and hydrodesulfurization of the naphtha hydrocarbons.

14. The process of claim 10, further comprising passing the vapor stream to a charge heater prior to step (e).

15. The process of claim 10, wherein the vapor stream is admixed with a hydrogen rich gas stream prior to step (e).

16. An apparatus for hydrotreating full range naphtha, the apparatus comprising:

a diolefin reactor in downstream communication with a full range naphtha feedstock conduit;

a separation unit in downstream communication with the diolefin reactor and in upstream communication with a plurality of naphtha fraction conduits comprising a medium naphtha fraction conduit and a heavy naphtha fraction conduit;

a vapor-liquid separation unit in downstream communication with the heavy naphtha fraction conduit and in upstream communication with a vapor conduit and a heavy naphtha liquid conduit;

a mixed naphtha liquid conduit in downstream communication with the medium naphtha fraction conduit and the heavy naphtha liquid conduit; and a hydrotreating reactor comprising a first catalyst bed and a second catalyst bed, wherein the first catalyst bed is in downstream communication with the vapor conduit and the second catalyst bed is in downstream communication with the mixed naphtha liquid conduit;

wherein the first and second catalyst beds are arranged in series within the hydrotreating reactor, and the second catalyst bed is in downstream communication with the first catalyst bed.

17. The apparatus of claim 16, wherein the separation unit comprises a distillation column.

18. The apparatus of claim 16, further comprising a charge heater in downstream communication with the vapor conduit and in upstream communication with the first catalyst bed.

19. The apparatus of claim 16, further comprising a hydrogen rich gas conduit in upstream communication with vapor conduit.

* * * * *